US007690642B2

(12) United States Patent
Roberts et al.

(10) Patent No.: US 7,690,642 B2
(45) Date of Patent: Apr. 6, 2010

(54) METHOD OF CONTROLLING ENVIRONMENT WITHIN MEDIA FEED STACK

(75) Inventors: Aldwin A. Roberts, Macedon, NY (US); Jamison DeLorenzo, Webster, NY (US); David L. Rasmussen, Fairport, NY (US); Michele D. Cleary, Rochester, NY (US); Joseph C. Farbizio, Walworth, NY (US); Lawrence D. Dipzinski, Macedon, NY (US); David M. Gurak, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 108 days.

(21) Appl. No.: 11/684,327

(22) Filed: Mar. 9, 2007

(65) Prior Publication Data

US 2008/0217838 A1 Sep. 11, 2008

(51) Int. Cl.
*B65H 3/14* (2006.01)
*B65H 3/46* (2006.01)

(52) U.S. Cl. ..... 271/97; 271/105; 271/98

(58) Field of Classification Search ..... 271/97, 271/98, 105

See application file for complete search history.

(56) References Cited

U.S. PATENT DOCUMENTS

| | | | | | |
|---|---|---|---|---|---|
| 4,768,769 | A * | 9/1988 | Roller | 271/11 |
| 5,088,713 | A * | 2/1992 | Hayashi | 271/3.03 |
| 5,138,378 | A * | 8/1992 | MacDonald et al. | 399/40 |
| 5,634,634 | A * | 6/1997 | Dobbertin et al. | 271/3.02 |
| 5,818,508 | A * | 10/1998 | Straayer et al. | 347/262 |
| 5,876,030 | A * | 3/1999 | Dobbertin et al. | 271/13 |
| 6,424,810 | B1 * | 7/2002 | Chappell | 399/92 |
| 6,450,493 | B1 * | 9/2002 | Milillo et al. | 271/11 |
| 6,994,340 | B2 * | 2/2006 | Clark et al. | 271/97 |
| 7,007,944 | B1 * | 3/2006 | Dobbertin et al. | 271/98 |
| 2005/0110207 | A1 | 5/2005 | Moore et al. | |
| 2006/0170145 | A1 * | 8/2006 | Nakane | 271/97 |

* cited by examiner

*Primary Examiner*—Patrick H Mackey
*Assistant Examiner*—Patrick Cicchino
(74) *Attorney, Agent, or Firm*—Oliff & Berridge, PLC

(57) ABSTRACT

A method maintains an environment within an interior of a sheet feeder during dead-cycling of an image forming device to which the sheet feeder is operatively connected. The method jets pulses of air into the interior of the sheet feeder that houses two or more pieces of media therein while the image forming device is dead-cycling. By the method, the attractive forces between two pieces of adjacent media. In a stack are reduced or minimized, and feeding of multiple sheets can be reduced or eliminated.

19 Claims, 3 Drawing Sheets

METHOD OF CONTROLLING ENVIRONMENT WITHIN MEDIA FEED STACK

TECHNICAL FIELD

This application relates to a method of controlling an environment within a media feeding device by jetting air into media within the device. More in particular, the application relates to a method of controlling an environment within a media feeding device by pulsing air into media, for example in a stack, for improving the environment to separate the media, such as paper, and/or for reducing a rate of multiple sheet feeds in a media feeding device, for example, a paper feeder used in conjunction with a printer or a xerographic device.

BACKGROUND

Paper feeding devices for transferring individual sheets of paper into an image forming device such as a copier or a printer from a tray of the paper feeder are known. Typically, a stack of paper is positioned on the tray to be individually transferred into the image forming device for imaging by the image forming device. Typically, the paper feeder has a shuttle vacuum feed-head located adjacent to a top side of the stack of paper to separate an uppermost piece of paper from the stack of paper. Additionally, the paper feeder has fluffer jets located adjacent to one or more exterior edges of the stack of paper for separating the sheets of paper within the stack on the tray of the paper feeder prior to feeding the paper into the image forming device.

U.S. Patent Publication No. US 2005/0110207 A1, incorporated herein by reference in its entirety, describes a sheet curl correction method and a feeder apparatus for an electrophotographic printing machine and a vacuum corrugation shuttle feed head. The method for correcting sheet curl in a paper feeder having a tiltable tray comprises (a) detecting a first distance above a surface of a stack of sheets on the tiltable tray to be fed into the printing machine at a first location above the stack of sheets; (b) detecting a second distance above the surface of the stack of sheets on the tiltable tray to be fed into the printing machine at a second location above the stack; and (c) detecting a third distance above the surface of the stack of sheets to be fed into the printing machine at a third location above the stack. The method tilts the tiltable tray based upon the first, second, and third distances detected.

During operation of the image forming device, such as processing tasks, a first valve connected to the shuttle vacuum feed-head opens and reduces air pressure within the feeder adjacent to the uppermost piece of paper and the top side of the stack of paper. A second valve connected to the flutter jets opens to transfer air into the paper feeder adjacent to the exterior edges of the stack of paper. The air pushes or moves between the sheets of paper within the stack to separate one or more sheets of paper. As a result, upper sheets of paper from the stack are separated from each other and are pulled inwardly with respect to the shuttle vacuum feed-head. The shuttle vacuum feed-head may receive a top piece of paper from the stack and may feed the top piece of paper into the image forming device via a take away roll (hereinafter "TAR") connected to the paper feeder. As a result, the top sheet of paper from the stack is fed into the image forming device, by the TAR, separately with respect to other sheets of paper because the fluffer jets separated or fluffed the stack of paper.

Often, sheets of paper have exterior surfaces with a coating, such as for gloss, which may permit moisture to collect between the sheets of paper within the stack. Such moisture may cause two adjacent sheets to adhere together sufficiently that both sheets are sucked together onto the vacuum teed-head. Further, the coating of the paper may become sticky from heat and moisture, which may further strengthen the attractive forces causing the pieces of paper to adhere to each other. Similarly, either static forces or attractive forces may exist between exterior surfaces of two or more sheets of paper which prevent separation of the sheets of paper by the shuttle vacuum feed-head and/or the fluffer jets.

The static forces or the attractive forces between the sheets of paper may increase and/or may strengthen as the printing device is dead-cycling or is not processing images because of an environment within the paper feeder, for example, due to heat and/or moisture created by the device during dead-cycling. Traditionally, dead-cycling is a condition of the printing device in which one or more of the drive motors of the printing device are activated without producing output prints while an embedded control system performs print appearance adjustments. The environment within the paper feeder may contain moisture which may collected between one or more sheets of paper therein to increase the attractive forces between the sheets of paper. The environment within the paper feeder may also be a closed environment that includes heat generated from the paper feeder or the image forming device. This environment may encourage sticking of and attraction between sheets of paper within the paper feeder. The increased attractive forces prevent the sheets of paper in the stack from being readily separated after the imaging device has completed dead-cycling. Further, the pieces of paper may remain attached to each other because of the increased attractive forces therebetween when the vacuum feed-head picks up the top sheet of paper.

The shuttle vacuum feed-head may thus receive two or more sheets of paper from the stack instead of receiving only the top sheet of paper when the image forming device is activated after dead-cycling. As a result, the shuttle vacuum feed-head may receive more than one sheet of paper from the tray and may transfer more than one sheet of paper into the TAR. By transferring more than one piece of paper into the TAR, a multi-feed of paper occurs, which may cause a paper jam, a misprinted job, and can even damage inner mechanics of the imaging device. Additionally, the multi-feed of paper may result in the TAR not properly introducing additional sheets of paper into the image forming device. A multi-feed of paper is thus undesirable and/or costly in many potential ways, and should be avoided.

Traditionally, preventing multi-feeds of paper from entering the TAR or the image forming device after dead-cycling of the image forming device required that the stack of paper within the paper feeder be replaced with a new stack of paper. Static forces or attractive forces between sheets of paper within the new stack of paper may be weaker than the forces between the sheets of paper within the stack removed from the paper feeder. However, the closed environment may still contain moisture or heat from the image forming device or the paper feeder that encourages sticking and/or attraction between the sheets of the new stack of paper. Also, the constant use of new stacks of paper is impractically costly.

A need, therefore, exists for a method of controlling an environment within a media feeding device, particularly during dead-cycling, to minimize or prevent static and attractive force between adjacent sheets of stacked media for preventing or hindering separation of the individual sheets by the feeder. Further, a need exists for a method of controlling an environment within a media feeding device which reduces static forces or attractive forces between pieces of media in a stack during dead-cycling of an image forming apparatus. Still further, a need exists for a method of controlling an environment within a media feeding device which reduces a rate of multi-feeding of separate pieces (i.e., sheets) of the media into an image forming device. Moreover, a need exists for a method of controlling an environment within a media feeding device which fluffs, dries or separates pieces of media within a paper feeder to prevent damage to a take away roll or the image forming apparatus.

SUMMARY

According to aspects illustrated herein, there is provided a method for controlling an environment within an interior of a sheet feeder operatively connected to an image forming device. The method includes, during a period in which the image forming device is dead-cycling, jetting pulses of air into the interior of the sheet feeder housing two or more pieces of media therein.

In embodiments, there is provided a method for controlling an environment within an interior of a sheet feeder, wherein the sheet feeder is operatively connected to an image forming device. The method includes determining that the image forming apparatus is dead-cycling for a period of time and jetting pulses of air into the interior of the sheet feeder for a first duration of time via a sheet jet fluffer as the image forming apparatus is dead-cycling wherein the sheet jet fluffer is located within the interior of the sheet feeder.

It is, therefore, an advantage of the various embodiments described herein to provide a method of controlling an environment within a media feeding device to minimize or prevent conditions encouraging attraction between pieces of media in a stack during dead-cycling. By pulsing jetted air into the media stack during dead-cycling, the occurrence of multi-feeds of sheets of the media may be reduced or eliminated.

Additional features and advantages of the various embodiments are described herein.

EMBODIMENTS

Figure 1:
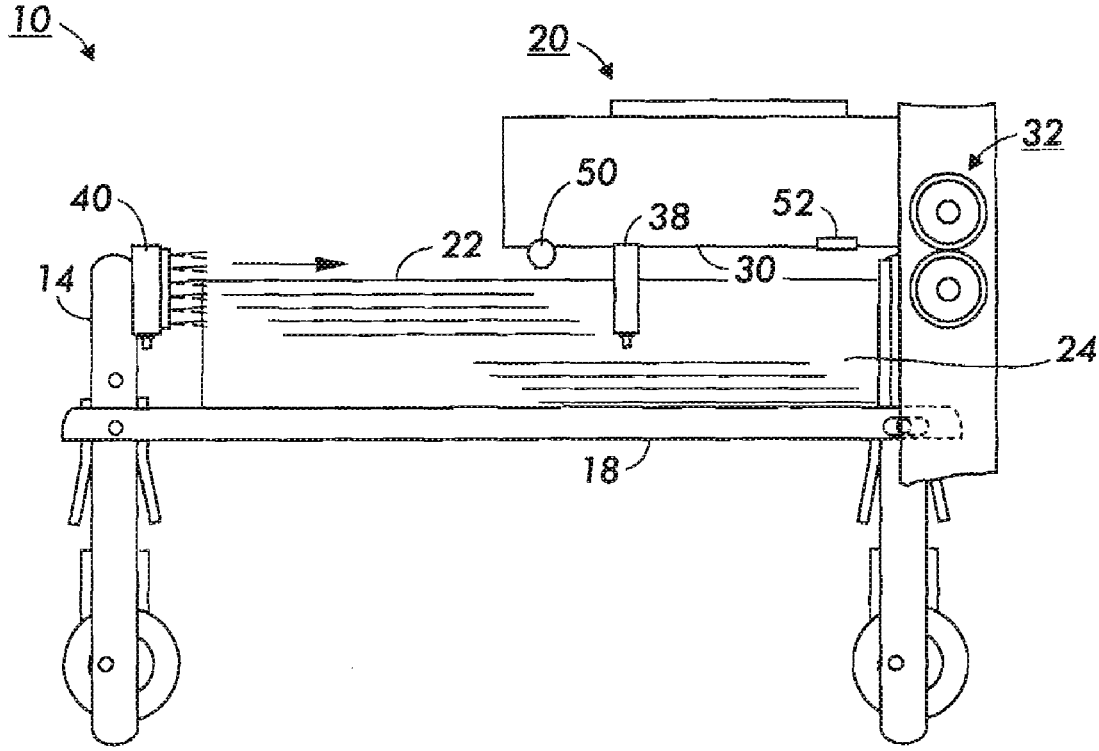
FIG. 1 illustrates a side view of a feeder for pulsing air to separate media in an embodiment of the present disclosure.

Described herein is a method of controlling an environment within a media feeding device by jetting air in pulses into media stacked within the feeding device. "Controlling" refers to, for example, substantially reducing or avoiding environmental conditions conducive to formation of sufficient attractive or static forces between pieces, for example, sheets, of media that prevent separation by a vacuum feed-head. "Controlling" also includes substantially maintaining current conditions where such conditions are not conducive to formation of the above-identified attractive or static forces.

The media feeding device has a support tray that may receive and store a stack of media to be transferred into an image forming apparatus. The media feeding device includes fluffer jets for jetting air into the media within the stack as the image forming apparatus is dead-cycling. The fluffer jets may be located within the interior of the feeder or may extend between a top side of the stack and a bottom side of the stack along an edge of the stack. The fluffer jets may be stationary with respect to the media feeding device. The tray may be adjustable and may move, for example, vertically with respect to the fluffer jets. As a result, the fluffer jets are typically positioned so as to be aimed at the topmost portion of a stack of media within the tray. As sheets of media are depleted from the stack, the tray may adjust its position to maintain the positioning of the jets towards the topmost portion of the stack.

As the image forming apparatus is dead-cycling, a controller may control a switch for directly opening and closing a valve connected to the fluffer jets to jet air into the interior of the media feeding device or between the pieces of media within the stack therein. Pieces of media, such as a first piece of media and a second piece of media, within the stack may be fluffed by the air from the fluffer jets as the image forming apparatus is dead-cycling. As a result, the air from the fluffer jets may control an environment within the media feeding device that causes occurrences of attractive forces or static forces between pieces of the media to be minimized or avoided. The air from the fluffer jets is pulsed at a frequency and/or for a duration to control the environment within the feeder for fluffing the stack of media. As a result, the air pulse-jetted into the pieces of media may separate each piece of media to reduce a rate of multi-feeding of media and/or a rate of feeding jams by the media as the image forming apparatus is activated from dead-cycling.

The term "image forming apparatus" refers to, for example, a printer, a copier or a multifunction machine, such as a xerographic marking device, a xerographic color printer, an electrophotographic printing machine, an imaging device, a marking device, a digital photocopier, and the like. The image forming apparatus may process tasks for imaging, such as transferring ink and/or toner powder to pieces of the media. After processing one or more tasks, the image forming apparatus may complete the tasks requested. Without having additional tasks to process, the image forming apparatus may begin dead-cycling and/or may be deactivated until a task is requested. Dead-cycling refers a condition of the image forming apparatus in which one or more of drive motors of the image forming apparatus may be activated without outputting pieces of media with images, while an embedded control system performs print appearance adjustments for the image forming apparatus.

Each piece of media may have exterior surfaces for receiving ink or toner powder from the image forming apparatus. Each piece of media may be, for example, any sheet made of a material, such as paper, cellulose pulp, plastic or any other suitable substrate for receiving toner powder or ink images from the image forming apparatus. desirably, the media is comprised of paper. Paper characteristics, such as dimensions and weight, may be loaded into a print station controller (not shown in the drawings) by an operator or may be determined automatically by sensors within the feeder. In embodiments, the exterior surfaces of media may be non-coated or may have a coating, such as, for example, a gloss. In embodiments, each piece of the media may be, for example, precut, web-fed and the like.

Figure 2:
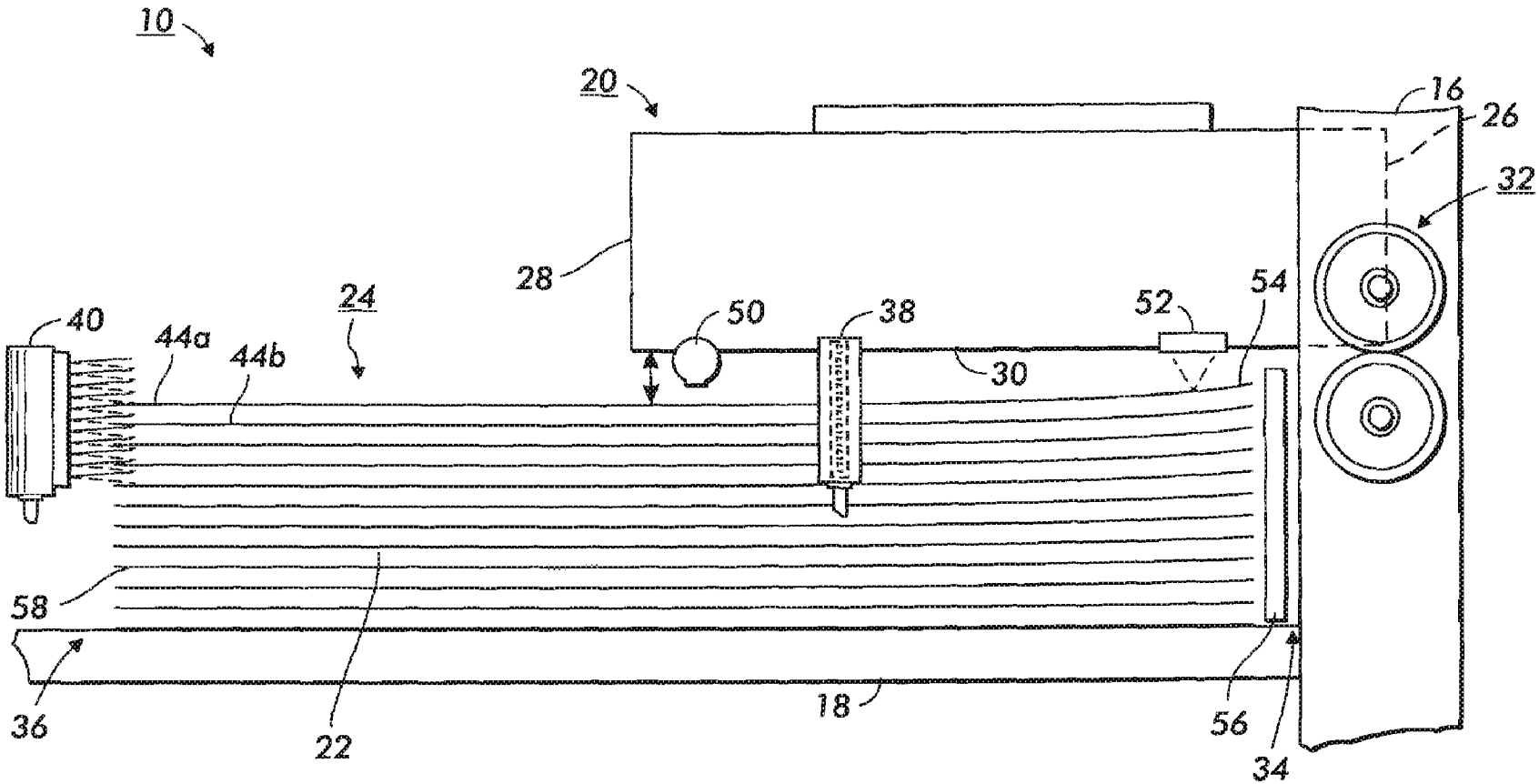
FIG. 2 illustrates a detailed side view of a feeder for pulsing air to separate media in an embodiment of the present disclosure.

Referring now to the drawings wherein like numerals refer to like parts, FIGS. 1 and 2 illustrate a feeder 10 having an interior 12 defined between a first wall 14 and a second wall 16. The feeder 10 may have a tiltable sheet support tray 18 (hereinafter "tray 18") and a vacuum feed-head 20. The interior 12 of the feeder 10 may be located between the tray 18 and the vacuum feed-head 20. The interior 12 of the feeder 10 may be sized and shaped to receive a stack 24 comprised of two or more pieces of media 22 (hereinafter "stack 24"), and thus to house the stack 24. As a result, the media 22 and the stack 24 may be located within the interior 12 of the feeder 10.

The vacuum feed-head 20 may have a length defined between a proximal end 26 and a distal end 28. The proximal end 26 of the vacuum feed-head 20 may be mounted to or connected to the second wall 16 of the feeder 10. In an embodiment, the vacuum feed-head 20 may be integrally formed with the second wall 16 of the feeder 10. The distal end 28 of the vacuum feed-head 20 may extend inwardly with respect to the first wall 14 of the feeder 11. The term "vacuum feed head" refers to, for example, a vacuum shuttle feed head, a vacuum corrugation shuttle feed head, a skirted shuttle feed head and the like. It should be understood that the vacuum feed head may be any vacuum feeder known in the art.

The vacuum feed-head 20 may have an acquisition side 30 which may be directed towards or may be located adjacent to the interior 12 of the feeder 10. The acquisition side 30 of the vacuum feed-head 20 may have an array of vacuum tubes (not shown in the drawings). Each of the vacuum tubes may be pneumatically connected to a vacuum source (not shown in the drawings) to provide vacuum forces through the vacuum tubes. The vacuum forces provided by the vacuum source may lift or may pull a piece of the media 22 inwardly with respect to the array of vacuum tubes on the acquisition side 30 of the vacuum feed-head 20. As a result, a piece of the media 22 may be moved inwardly with respect to the acquisition side 30 via the vacuum forces from the array of vacuum tubes.

A take away roll 32 (hereinafter "TAR 32") may be mounted to, connected to and/or attached to the second wall 16 of the feeder 10. In embodiments, the TAR 32 may be integrally formed with the second wall 16 of the feeder 11. The TAR 32 may be located or may be positioned adjacent to the acquisition side 32 of and the proximal end 26 of the vacuum feed-head 20. The vacuum feed-head 20 may deliver each piece of media from the stack 24 within the feeder 10 to the TAR 32. In embodiments, the TAR 32 may be, for example, a variable acceleration take away roll and the like.

The array of vacuum tubes may apply vacuum forces to the uppermost piece of media 22 to lift the uppermost sheet of media 22 remaining on the tray 18. The vacuum forces are intended to separate the uppermost piece of media 22 when the image forming apparatus is activated and is not dead-cycling. Further, the vacuum forces may pull the uppermost piece of media 22 inwardly with respect to the acquisition surface 30 of the vacuum feed-head 20. As a result, the uppermost piece of the media 22 or the first sheet 44*a* may contact or may abut the acquisition surface 30 of the vacuum feed-head 20 for transferring the uppermost piece of the media 22 or the first sheet 44*a* from the vacuum feed-head 20 to the TAR 32. The uppermost piece of media 22 or the first sheet 44*a* may be transferred to the TAR 32 via the vacuum feed-head 20. The TAR 32 may transfer the uppermost piece of media 22 or the first sheet 44*a* to the imaging forming apparatus.

For proper feeding with the vacuum feed-head 20, an appropriate distance between an uppermost piece of media 22 remaining on the tray 18 and the acquisition surface 30 may be controlled by the first sheet fluffer jets 38 and/or second sheet fluffer jets 40 (collectively known hereinafter as "jets 38, 40"). The fluffer jets 38, 40 may be located within the interior 12 of the feeder 10 as shown in FIGS. 1 and 2. The first sheet fluffer jets 38 (hereinafter "first jets 38") may be mounted to or may be attached to the vacuum feed-head 20. The first jets 38 may extend outwardly from the acquisition surface 30 into the interior 12 of the feeder 10. The second sheet fluffer jets 40 (hereinafter "second jets 40") may be mounted to or may be attached to the first wall 14 of the feeder 10. The second jets 40 may extend outwardly from the first wall 14 into the interior 12 of the feeder 10.

The jets 38, 40 may have a configuration, such as, for example, a single-headed jet configuration or a multiple-headed jet configuration for pulsing air into the interior 12 of the feeder 10. The jets 38, 40 may be in the form of a single vertical row, or may include multiple vertical rows. In embodiments, the jets 38, 40 may extend an entire distance from the feeder 10 to the tray 18 for jetting air into the interior 12 of the feeder 10. It should be understood that the configuration of the jets 38, 40 may be any suitable configuration.

The acquisition surface 30 of the vacuum feed-head 20 may be a functional surface on the vacuum feed-head 20 or a vacuum plenum. Sensors 50, 52 may be employed on the vacuum feed-head 20 to maintain the appropriate distance between the uppermost piece of media 22 in the stack 24 and the acquisition surface 30. The sensors 50, 52 in the vacuum feed-head 20 may detect a proximity of the stack 24 with respect to the acquisition surface 30 and/or a curl of the pieces of media 22 within the stack 24.

The TAR 32 may be coupled to and/or may be used in conjunction with an image forming apparatus (not shown in the drawings). As a result, the TAR 32 may be located or may be positioned between the feeder 10 and the image forming apparatus. The TAR 32 may receive a piece of media 22 from the vacuum feed-head 20 and/or may transfer the piece of media 22 to the imaging forming apparatus for receiving a toner or ink.

The tray 18 may be mounted to, may be connected to and/or may be attached to the first end 14 of and/or the second end 16 of the feeder 10. In embodiments, the tray 18 may be integrally formed with the first end 14 or the second end 16 of the feeder 10. In an embodiment, the tray 18 may be self adjusting to accommodate and/or to receive pieces of media 22 that have various shapes, sizes, and/or characteristics.

The tray 18 may have a length defined between a first end 34 and a second end 36 that may be mounted to or may be connected to elevator drives (not shown in the drawings). The elevator drives may tilt, may lift, may lower or may move the tray 18 with respect to the acquisition surface 30 of the vacuum feed-lead 20 by moving the first end 34 or the second end 36 inwardly or outwardly with respect to the vacuum feed-head 20. A tilt by the elevator drives to compensate for a curl of the stack 24 may be limited to a maximum tilt to prevent a large gap between a leading edge 54 (hereinafter "the LE 54") of the pieces of media 22 and a leading edge registration wall 56 (hereinafter "the LE wall 56"). The tray 18 may be moved to position the uppermost piece of media 22 of the stack 24, such as a first sheet 44*a* adjacent to the acquisition surface 30 of the vacuum feed-head 20. As a result, the stack 24 on the tray 18 may be moved inwardly and/or outwardly with respect to the vacuum feed-head 20 via the tray 18 and/or the elevator drives.

In embodiments, the sensors 50, 52 may determine an initial amount of compensation necessary for the stack 24 to be adjacent to the acquisition surface 30 of the vacuum feed-head 20. By tilting of the tray 18, the LE 54 of the first sheet 44*a* may be moved into a proper location with respect to the acquisition surface 30 of the vacuum feed-head 20 and the fluffing jets 38, 40. To achieve corrective tilting action of the stack 24, a height of the first sheet 44*a* near LE 54 of the first sheet 44 with respect to the acquisition surface 30 may be sensed by the sensors 50, 52 with the air from the jets 38, 40 fluffing the stack 24 of media 22.

In embodiments, stack heights of the stack 24 may be detected by the sensors 50, 52 and identified as within, for example, zones (not shown in the figures), such as a first zone, a second zone, a third zone and a fourth zone. The first zone may identify that the first sheet 44*a* is less than about 3 millimeters (hereinafter "mm") from the acquisition surface 30. The second zone may identify that the first sheet 44*a* is within a range of about 3 mm and about 6 mm from the acquisition surface 30. The third zone may identify that the first sheet 44*a* is within a range of about 6 mm and about 9 mm from the acquisition surface 30. The fourth zone may identify that the first sheet 44*a* is greater than about 9 mm from the acquisition surface 30. Pieces of media, for example sheets of paper, within the first zone may be acquired by the vacuum feed-head 20 via the vacuum forces from the acquisition surface 30. A capability to vertically and angularly control the stack 24 to properly position within the first zone with respect to the acquisition surface 30 may improve a capability of the feeder 10 to process and manage with a wide range of paper basis weight, type, and curl of the media 22 within the stack 24.

In embodiments, "pitch time" refers to an amount of time that may be required for the acquisition surface to separate the uppermost sheet from the stack 24 and to suck or to receive the uppermost sheet from the stack 24. The pitch time of the feeder 10 may relate to the stack heights of the stack 24 that is detected by the sensors 50, 52. That is the greater the distance between the stack 24 and the vacuum feed-head 20, the greater the pitch time. Moreover, the pitch time of the feeder 11 may be dependent upon and/or may be based on a location of the first sheet of media 44*a* with respect to the acquisition surface 30 or the sensors 50, 52. Thus, the pitch time of the feeder 10 may be indicative of or may be based on the first zone, the second zone, the third zone or the fourth zone of the stack heights of the stack 24 as determined and identified by the sensors 50, 52.

Figure 3:
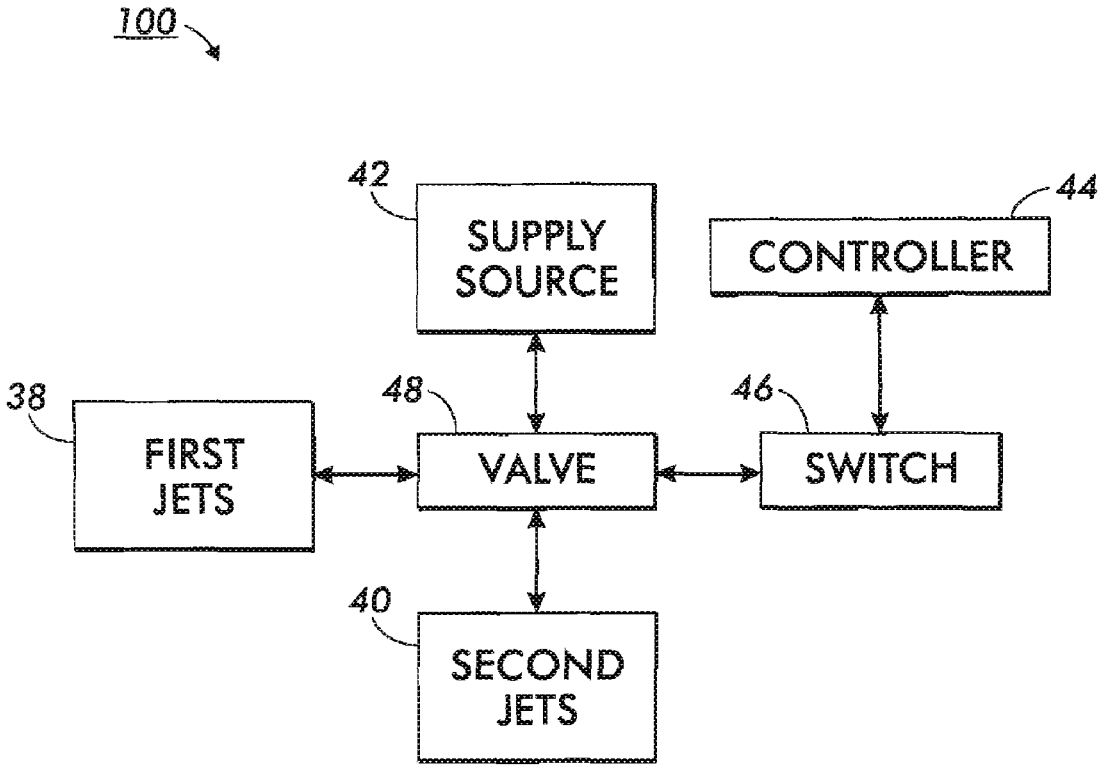
FIG. 3 illustrates a black box diagram of a system for pulsing air into an interior of a feeder in an embodiment of the present disclosure.

A system 100 for controlling the environment with the interior 12 of the feed 10 may have a controller 44, a switch 46 and/or a valve 48 for controlling the supply source 42 to provide air to the jets 38, 40, for example as shown in FIG. 3. The jets 38, 40 may be connected to the supply source 42 of the system 100 for receiving or for transferring air from the supply source 42. The supply source 42 may provide or supply air to the jets 38, 40 for pulse-jetting the air into the interior 12 of the feeder 10. The air from the jets 38, 40 may be jetted in pulses into the interior 12 of the feeder 1I or between pieces of the media 22 within the stack 22 on the tray 18 for controlling the environment therein. The air from the jets 38, 40 may pulse in between two or more pieces of media 22 within the stack 24 to overcome the static forces and/or the attractive forces therebetween. As a result, the air jetted by the jets 38, 40 may fluff the stack 24 as the image forming apparatus is dead-cycling.

The controller 44 may be electrically connected and/or in communication to the switch 46 for moving the valve 48 to open positions or to closed positions. In an open position, the valve 48 is open and/or is unblocked for allowing and/or for permitting air from the air supply 42 to flow to and/or to be transferred to the jets 38, 40. In a closed position, the valve 48 is closed and/or is sealed to preventing air from the air supply 42 from flowing to and/or from being transferred to the jets 38, 40.

While it is possible for the second valve of the fluffer jets to remain in an open position during dead-cycling by the printing machine, this would result in the fluffer jets continuously transferring air into the interior of the paper feeder as the printing machine is dead-cycling. However, a continuous stream of air from the fluffer jets may not be forced between the sheets of paper, and may not separate or fluff the sheets of paper within the stack adequately during dead-cycling by the printing machine. As a result, the vacuum feed-head may be unable to receive the top sheet of paper from the stack when the printing machine is activated from dead-cycling. Thus, the vacuum feed-head may transfer more than one sheet of paper to the TAR or the image forming device.

The jets 38, 40 thus pulse air into the interior 12 of the feeder 10 by jetting air from the supply source 42 inwardly with respect to the interior 12 of the feeder 11. "Pulse" or "pulsing" refers to, for example, a burst of air being jetted from the jets 38, 40 into the interior 12 of the feeder 10 for short periods of time in a repetitive manner. A single pulse may be done by having the valve 48 in the open position for a first duration of time in, for example, a range of about 5 microseconds (hereinafter "ms") to about 50 ms and more specifically in a range of about 10 ms to about 20 ms. The burst of air may occur for the first duration of time, then the valve 48 may move to the closed position to prevent air from being jetted into the interior 12 of the feeder 10. Subsequently, the valve 48 may be rapidly and repeatedly opened and closed for additional durations of time similar to the first duration of time to create pulsing jetted air. The burst of air may be transferred throughout the interior 12 of the feeder 10 or between one or pieces of media 22 therein.

Pulsing air into the interior 12 of the feeder 10 during dead-cycling of the image forming apparatus may maintain the environment at conditions that minimize or avoid increasing of the attractive forces between pieces of media 22. By pulsing air into the interior 12 during dead-cycling of the image forming apparatus, the air may reduce or may decrease moisture or heat located within the interior 12 or between pieces of media 22 therein. Further, by pulsing air into the interior 12 during dead-cycling of the image forming apparatus, the air may reduce stickiness between two or more pieces of media 22 within the interior 12 of the feeder 10. The air pulses may also physically go between two adjacent pieces of media to fluff the media, separate the media and/or maintaining separability of the media by a vacuum feed-head. As a result, the pulsing air may reduce occurrences of multiple feeds of media into, and misprints by, the image forming apparatus.

In embodiments, the feeder 10 may pulse air into the feeder 10 or between the pieces of media 22 via the jets 38, 40 as the image forming apparatus initializes and/or executes dead-cycling. As a result, the pulsing air jetted from the jets 38, 40 may reduce moisture, heat and/or other attractive or static forces tending to increase conditions within the interior 12 of the feeder 10 and/or between pieces of media 22 within the stack 24. The air from the jets 38, 40 nay dry the pieces of media 22 within the stack 24 or may fluff the stack 24 with the air. Moreover, the jets 38, 40 of the feeder 10 may stop or terminate pulsing air when the dead-cycling is completed or is terminated.

The pulsing air by the jets 38, 40 during dead-cycling is advantageous because the pulsing air dry moisture and may remove heat from the interior 12 of the feed 10 and from the pieces of media 22 therein. As a result, the pulsing air prevents multiple feeds of media 22 into and misprints by the image forming apparatus more often than when the jets 38, 40 are continuously jetting air into the interior 12 during the dead-cycling.

Failure to pulse air from the jets 38, 40 during dead-cycling may increase or may strengthen the attractive forces between the pieces of media 22 within the stack. Therefore, the feeder 10 may jet the pulsing air into the interior 12 of the feeder 10 via the jets 38, 40 to overcome the attractive forces therebetween. As a result, the pieces of media 22 within the stack 24 may be fluffed or dried to maintain the environment therein by the jetting and/or pulsing air from the jets 38, 40 as the image forming apparatus is dead-cycling.

To pulse air into the feeder while the apparatus is dead-cycling, the controller 44 may transmit electrical signals to the switch 46 for moving the valve 48 to open positions or to closed positions. After receiving a first electrical signal from the controller 44, the switch 46 may move the valve 48 to the open position for pulsing air from the supply source 42 to the jets 38, 40. Alternatively, the switch 46 may receive a second electrical signal from the controller 44 and move the valve 48 to the closed position to prevent air from the supply source 42 from reaching the jets 38, 40. Although the signals, and thus the opened state and the closed state of the valve 48, achieve, the desired pulsing.

The controller 44 may determine that the valve 28 has been located in the closed position for the second duration of time and/or that the second duration of time has expired and/or has elapsed. The controller 44 may transmit a third electrical signal to the switch 46 for moving the valve 48 from the closed position to the open position. The pulsing air from the jets 38, 40 into the interior 12 of the feeder 10 may have a cycle time that is an amount of time from when the switch 46 receives the first signal from the controller 44 to when the switch 46 receives the third signal from the controller 44. Alternatively, the cycle time may be a duration of time that the valve 48 may be located in the open position between being moved to the closed positions.

For example, the feeder 10 may have a pitch time in a range of about 450 ms and about 1500 ms and more specifically in a range of about 500 ms and 750 ms. In embodiments, longer pitch times may correspond to stack heights of the stack 24 which are located within the fourth zone. In embodiments, shorter pitch times may correspond to stack heights of the stack 24 which may be located within the first zone. The jets 38, 40 may have a start delay time with the valve 48 closed prior to the valve 48 moving to the open position. The start delay time may be a period of time extending from the beginning of dead-cycling by the image forming device and ending when the valve 48 moves to the open position. The start delay time may be, for example, in a range of about 5 ms and 25 ms and more specifically in a range of about 10 ms and 20 ms. Further, the jets 38, 40 may have a stop delay time with the valve 48 opened prior to the valve 48 moving to the closed position. The stop delay time may be a period of time extending from the beginning of dead-cycling by the image forming device and the ending when the valve 48 moves to the closed position. The stop delay time may be, for example, in a range of about 80 ms and about 120 ms and more specifically in a range of about 90 ms and 110 ms.

In embodiments, cycling of the valve 48 may occur anytime a dead cycle period is eater than or equal to three times the current pitch time. The valve cycling may stop one pitch prior to the start of a feed request, and in this way pulsing may be stopped prior to resumption of operations following completion of dead-cycling. The valve cycle time may be downloaded to or stored within the controller 44. The valve cycle time may be used for a cycling interval during dead cycles and may be equal to a cycle time used for a pre-feed fluffing of the stack 24. The controller 44 may enable or may disable valve cycling for the valve 48. The valve delay may depend from, may be based on or may be determined from the pitch associated with the tray 18. The pitch may be between a range of about 12 and 4 ms and the valve delay may be within a range of from about 100 ms to about 1200 ms between valve cycles.

In embodiments, the controller 44 may determine that the valve 48 has been located in the open position for the first duration of time or that the first duration of time has expired or has elapsed. The controller 44 may transmit the second electrical signal to the switch 46. The switch 46 may move the valve 48 to the closed position and/or may maintain the valve in the closed position for a second duration of time. As a result, the valve 48 may prevent air from being provided to the jets 38, 40 by the supply source 42 for the second duration of time. The second duration of time may be in, for example, a range of about 200 ms to 1100 ms and more specifically in a range of about 300 ms to about 1000 ms.

The pieces of media 44*a* may be fluffed or may be dried by the pulsing air form the jets 38, 40 to maintain the environment within the interior 12 of the feeder 10 during dead-cycling by the image forming apparatus. As a result, the first piece of media 44*a* may be fluffed with respect to a second piece of media 44*b* within the stack 22 via the pulsing air jetted by the jets 38, 40 as the image forming device is dead-cycling. Further, the pulsing air from the jets 38, 40 may prevent and/or substantially reduce conditions within the interior 12 that increase the attractive forces between pieces of media 22 therein as the image forming apparatus is dead-cycling. As a result, the pulsing air from the jets 38, 40 prevent or reduce occurrences of multiple feeds into or misprints by the image forming apparatus that may be caused by the conditions of the environment within the interior 12 of the feeder 10.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for controlling an environment within an interior of a sheet feeder operatively connected to an image forming device, comprising:

during a period in which the image forming device is dead-cycling, jetting pulses of air into the interior of the sheet feeder that houses two or more pieces of media therein, wherein dead cycling occurs when one or more motors of the image forming device are activated without outputting pieces of media, and a control system performs print appearance adjustments for the image forming apparatus.

2. The method according to claim 1 further comprising:

positioning at least one sheet fluffer jet adjacent to the two or more pieces of media located within the interior of the sheet feeder, wherein the at least one sheet fluffer jet jets the pulses of air into the interior of sheet feeder.

3. The method according to claim 2, wherein the two or more pieces of media are stacked vertically in a tray of the sheet feeder with the sheet fluffer jet positioned to jet towards at least a topmost portion of the two or more pieces of media.

4. The method according to claim 1 further comprising:

collecting with a vacuum a single one of the two or more pieces of media within the interior of the sheet feeder.

5. The method according to claim 1 further comprising:

detecting a stack height between the two or more pieces of media and an acquisition surface of the sheet feeder, wherein a duration of each of the pulses of air is set based upon the detection of the stack height.

6. The method according to claim 1 further comprising:

conducting jetting until dead-cycling of the image forming device is terminated.

7. The method according to claim 1, wherein the two or more pieces of media have exterior surfaces that have a coating thereon.

8. The method according to claim 1 further comprising:

feeding a single sheet collected by vacuum to the image forming device following dead-cycling by the image forming device.

9. A method for controlling an environment within an interior of a sheet feeder, wherein the sheet feeder is operatively connected to an image forming device, comprising:

determining that the image forming apparatus is dead-cycling for a period of time;

jetting pulses of air into the interior of the sheet feeder wherein each of the pulses is jetted into the sheet feeder for a first duration of time via a sheet jet fluffer as the image forming apparatus is dead-cycling, wherein the sheet jet fluffer is located within the interior of the sheet feeder, wherein dead cycling occurs when one or more motors of the image forming device are activated without outputting pieces of media, and a control system performs print appearance adjustments for the image forming apparatus.

10. The method according to claim 9 further comprising:

after each jetting of air for the first duration of time, preventing air from pulsing into the interior of the sheet feeder for a second duration of time, wherein the second duration of time is less than the first duration of time.

11. The method according to claim 9 further comprising:

maintaining a separation ability of at least two pieces of media within the interior of the sheet feeder via the pulses of air.

12. The method according to claim 9 further comprising:

collecting with a vacuum a top sheet of media from the stack of media.

13. The method according to claim 9 further comprising:

repeatedly jetting pulses of air into the interior of the sheet feeder by opening and closing a valve.

14. The method according to claim 9 further comprising:

feeding a single sheet collected by vacuum to the image forming device following dead-cycling by the image forming device.

15. The method according to claim 9, wherein the jetting is not conducted unless the determining determines that the period of time of dead-cycling is greater than three times a pitch time for a vacuum head to acquire an uppermost piece of media.

16. A method for controlling an environment within an interior of a sheet feeder operatively connected to an image forming device, comprising:

determining that the image forming apparatus is dead-cycling for a period of time;

detecting a location of a first sheet of a stack of media within an interior of the sheet feeder; and jetting pulses of air into the interior of the sheet feeder for first durations of time, wherein the pulses of air are jetted inwardly with respect to the stack of media, wherein dead cycling occurs when one or more motors of the image forming device are activated without outputting pieces of media, and a control system performs print appearance adjustments for the image forming apparatus.

17. The method according to claim 16, wherein the jetting is not conducted unless the determining determines that the period of time of dead-cycling is greater than three times a pitch time for a vacuum head to acquire an uppermost piece of media.

18. The method according to claim 16 further comprising:

collecting with a vacuum the first sheet of media from the stack of media; and feeding the first sheet to the image forming device following dead-cycling by the image forming device.

19. The method according to claim 16 further comprising:

preventing air from pulsing into the interior of the sheet feeder for second durations of time, wherein the second durations of time are less than the first durations of time.

* * * * *